United States Patent [19]

Parsons et al.

[11] Patent Number: 4,587,525

[45] Date of Patent: May 6, 1986

[54] 180 DEGREE DIPOLE PHASE SHIFTER

[75] Inventors: Kenneth M. Parsons, Treasure Island, Fla.; Darrell L. Helms, Tucson, Ariz.

[73] Assignee: E-Systems, Inc., Dallas, Tex.

[21] Appl. No.: 577,751

[22] Filed: Feb. 7, 1984

[51] Int. Cl.[4] ..... H01Q 9/16

[52] U.S. Cl. ..... 343/821; 343/822

[58] Field of Search ..... 343/820, 821, 822, 371, 343/372, 374

[56] References Cited

U.S. PATENT DOCUMENTS

| | | | |
|---|---|---|---|
| 2,976,534 | 3/1961 | Kampinsky | 343/820 |
| 3,803,621 | 4/1974 | Britt | 343/821 |

*Primary Examiner*—Eli Lieberman

*Attorney, Agent, or Firm*—Albert M. Crowder, Jr.

[57] ABSTRACT

A dipole phase shifter for use in a phased array antenna includes an insulating substrate having first and second sides. A dipole element having first and second conductive dipole arms is formed on the first side of the insulating substrate and a PIN/NIP diode pair is mounted on the second side of the insulating substrate and electrically-connected to the first and second dipole arms, respectively. A coaxial RF transmission line having a center conductor extending through the insulating substrate connects an input signal to the phase shifter. Quarter-wave transformers are connected between the center conductor and the diodes to compensate for the forward and reverse bias reactances thereof. The first and second dipole arms serve as groundplanes for the quarter-wave transformers. The center conductor also serves as a common bias line which allows forward biasing of one diode and, simultaneously, reverse biasing of the other diode. The diodes therefore act as a single pole, double throw switch to effect a 180 degree change in phase of the input signal applied to the phase shifter.

16 Claims, 6 Drawing Figures

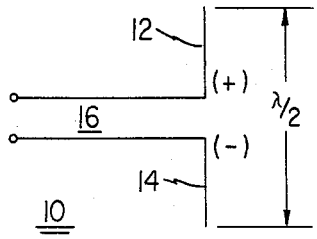
FIG. 1a
DIPOLE WITH BALANCED FEED
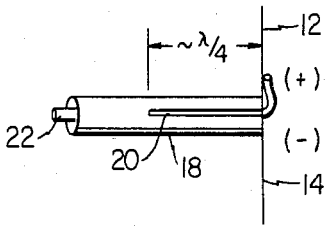
FIG. 1b
DIPOLE WITH UNBALANCED FEED AND BALUN TRANSFORMER
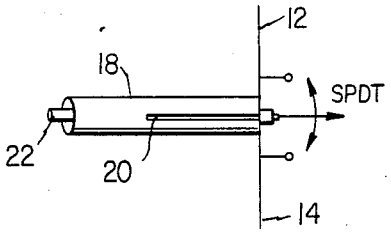
FIG. 1c
DIPOLE WITH BALUN AND SPDT SWITH
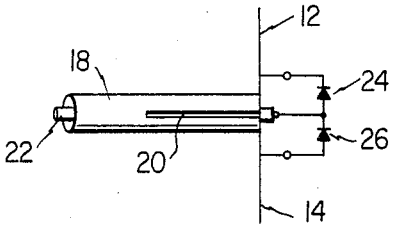
FIG. 1d
REALIZATION OF (c) WITH IDEAL DIODES
FIG. 2
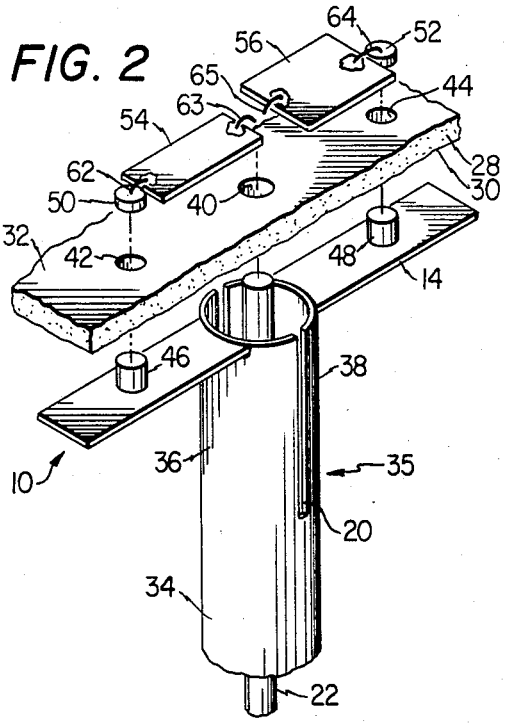
FIG. 3
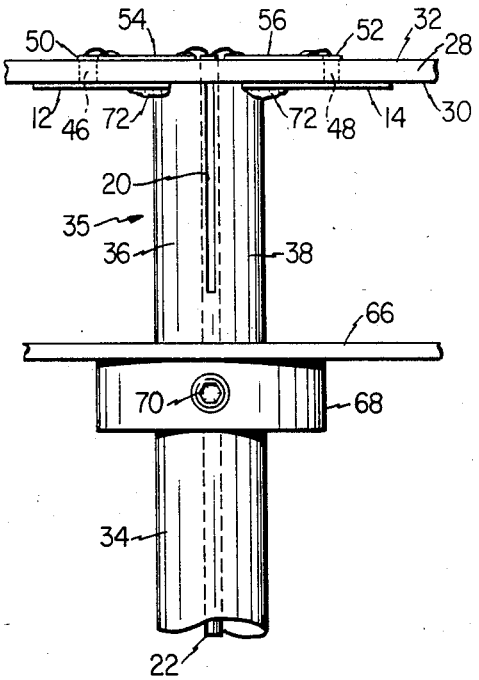

180 DEGREE DIPOLE PHASE SHIFTER

TECHNICAL FIELD

The present invention relates generally to microstrip phase shift devices and particularly to a dipole phase shifter for use in a phased array antenna.

BACKGROUND OF THE INVENTION

In large aperture phased array antennas, performance requirements such as high array gain and low slidelobe levels often preclude the use of thinning or increased element spacing to reduce element count. As a result, very large numbers of active elements are required; e.g., approximately 10,000 elements for a 1 degree beamwidth array operating at 10 GHz. Typically, each antenna element in the array includes a printed circuit microwave phase shifter which varies the phase of the signal input thereto. Such phase shifters comprise a microwave printed circuit etched on an alumina substrate, with conventional PIN diodes mounted to the circuit to provide the phase shift. The output of this circuit is typically connected to a radiating dipole element via an RF connector and length of semi-rigid RF cable.

In a phase shifter-per-element configuration, the phase shifter often becomes a major contributor to both the cost and weight of the phased array, as well as contributing significantly to the RF loss. Therefore, although conventional PIN diode phase shifter configurations provide reasonably efficient performance, there is a need to reduce phase shifter cost, weight and RF loss in phased array antenna design.

SUMMARY OF THE INVENTION

The present invention provides an improved phase shifter structure for use in a phased array antenna. According to the invention, a dipole having first and second conductive dipole arms is formed on a first side of an insulating substrate. A first diode of a predetermined conductivity type is mounted on the second side of the insulating substrate and electrically-connected to an input coaxial RF transmission line and the first dipole arm. A second diode of an opposite conductivity type is also mounted on the second side of the insulating substrate and electrically-connected to the coaxial RF transmission line and the second dipole arm. In operation, the center conductor of the coaxial RF transmission line serves as a common bias line for the diodes, allowing the diodes to be alternatively biased into a conductive state to produce a phase shift in an input signal applied to the phase shifter.

In accordance with the present invention, the phase shifter includes a quarter-wave transformer mounted on the second side of the substrate between the first diode and the center conductor of the RF coaxial transmission line to compensate for the forward and reverse bias reactances of the first diode. A quarter-wave transformer is also mounted on the second side of the substrate between the second diode and the center conductor to compensate for the forward and reverse bias reactances of this diode. According to the invention, the first and second dipole arms serve as groundplanes for the respective quarter-wave transformers. In a preferred embodiment of the invention, the diodes are secured to conductive pedestals mounted in the substrate. These pedestals electrically-connect the first and second diodes to the first and second dipole arms, respectively.

BRIEF DESCRIPTION OF THE DRAWINGS

For a more complete understanding of the present invention and the advantages thereof, reference is now made to the following Description taken in conjunction with the accompanying Drawings, in which:

FIGS. 1*a*–1*d* are schematic diagrams of an elementary dipole element which explains the underlying theory of the present invention.

FIG. 2 is an exploded view of the 180 degree dipole phase shifter of the present invention.

FIG. 3 is a partial side view of the 180 degree dipole phase shifter of the present invention incorporating a groundplane selectively located on the coaxial RF transmission line input.

DETAILED DESCRIPTION

Referring now to the drawings wherein like reference characters designate like or similar parts throughout the several views, FIGS. 1*a*–1*d* disclose the underlying theory of the 180 degree dipole phase shifter of the present invention. Referring to FIG. 1*a*, an elementary dipole element 10 comprising first and second dipole arms, 12 and 14, respectively, is shown fed from a balanced transmission line 16. As shown in FIG. 1*a*, the first and second dipole arm 12 and 14 extend a distance of approximately one-half the wavelength of the signal desired to be radiated. The first dipole arm 12 is arbitrarily shown to be at positive potential, with the second dipole arm 14 being at negative potential. When the dipole element 10 is to be fed from an unbalanced transmission line, the standard technique is to transform the unbalanced line to a balanced line using a balun 18 as shown in FIG. 1*b*. The balun 18 includes a longitudinal slot 20 whose length is approximately one-quarter wavelength.

The center conductor 22 of an RF coaxial transmission line is shown in FIG. 1*b* to be connected arbitrarily to the first dipole arm 12. This conductor, however, could alternatively be connected to the second dipole arm 14, thereby reversing the polarity of the first and second dipole arms. The difference between connecting the center conductor 22 to the first or second dipole arms is detected in the radiation pattern as a pure 180 degree phase shift. If a single pole, double throw (SPDT) switch were connected from the center conductor 22 to the first and second dipole arms 12 and 14, as shown in FIG. 1*c*, a change in the switch position would effect a 180 degree change in phase of the signal radiated. This is the basic idea for the 180 degree dipole phase shifter of the present invention. In particular, FIG. 1*d* shows a realization of the SPDT switch of FIG. 1*c* wherein nearly ideal diodes 24 and 26 are used to provide the 180 degree phase shift. In particular, the nearly ideal diode 24 is connected between the center conductor 22 and the first dipole arm 12. Likewise, the nearly ideal diode 26 is connected between the center conductor 22 and the second dipole arm 14. If the diodes 24 and 26 are alternatively biased, a single pole, double throw switch is formed. This switch produces the 180 degree phase shift in the input signal applied to the phase shifter.

If the diodes 24 and 26 were ideal; i.e., short circuit forward bias and open circuit reverse bias, the SPDT switch could be configured as in FIG. 1*d*. However, at the desired X-band (approximately 10 GHz.) operating frequencies of the 180 degree dipole phase shifter of the present invention, the forward bias lead inductance and reverse bias junction capacitance of the diodes 24 and 26 produce reactances which preclude the use of such a simplistic model. In RF switch design, one design method used to compensate for such reactances is to locate the diodes at the end of slightly foreshortened quarter-wave transmission lines of the proper characteristic impedance to transform the forward and reverse bias reactances of the diodes to open and short circuits, respectively. As will be described in more detail below, the 180 degree dipole phase shifter of the present invention utilizes this compensation technique in a novel way.

Referring now to FIG. 2, the phase shifter includes an insulating substrate 28 formed of a teflon/glass fibre material. The insulating substrate 28 includes a first side 30 and a second side 32. A dipole element 10 includes a first dipole arm 12 and a second dipole arm 14 mounted to the first side 30 of the insulating substrate 28. An RF input signal, whose phase is to be shifted, is applied to the phase shifter via a coaxial RF transmission line comprising the center conductor 22 and the outer conductor 34. The outer conductor 34 has a balun 35 integrally-formed therewith. In particular, the balun 35 includes a first section 36 and a second section 38 which define the longitudinal slot 20. As discussed above with respect to FIG. 1*b*, the length of the slot 20 is approximately equal to one-quarter of the wavelength of the input signal. The dipole of FIG. 2 is therefore equivalent to the dipole of FIG. 1*b* having an unbalanced feed and balun transformer.

Referring back to FIG. 2, the insulating substrate 28 has a central aperture 40 for receiving the end of the center conductor 22 of the coaxial RF transmission line. The insulating substrate 28 also includes apertures 42 and 44 for receiving conductive mounting pedestals 46 and 48. In particular, the conductive mounting pedestal 46 is mounted in aperture 42 and the conductive pedestal 48 is mounted in aperture 44. Mounting pedestal 46 serves two purposes; providing a support for a diode 50 of a first conductivity type, and serving to electrically connect the diode 50 to the first dipole arm 12. Similarly, the conductive mounting pedestal 48 serves to support a diode 52 of an opposite conductivity type, and also serves to electrically connect diode 52 to the second dipole arm 14. In a preferred embodiment of the invention, diode 50 is a microwave PIN diode, and diode 52 is a microwave NIP diode.

As discussed above, during operation of the phase shifter at desired frequencies, i.e., approximately 10 GHz., the forward bias lead inductance and reverse bias junction capacitance of the diodes 50 and 52 produces reactances which must be compensated. Therefore, in accordance with the present invention, quarter-wave transformers 54 and 56 are provided to transform the forward and reverse bias reactances of the diodes 50 and 52 to open and short circuits, respectively. More specifically, quarter-wave transformer 54 is connected between the center conductor 22 and the PIN diode 50 to transform, at the center conductor 22 location, the forward and reverse bias reactances thereof to open and short circuits, respectively. Similarly, the quarter-wave transformer 56 is connected between the center conductor 22 and the NIP diode 52 to transform, at the center conductor 22 location, the reactances thereof to open and short circuits. As seen in FIG. 2, the quarter-wave transformers 54 and 56 are electrically-connected to the diodes 50 and 52 by the leads 62 and 64, and to the center conductor 22 by leads 63 and 65.

The first dipole arm 12 is connected to the first section 36 of the balun 35, and the second dipole arm 14 is connected to the second section 38 of the balun 35. By using diodes of opposite conductivity types, the common bias line, i.e., the center conductor 22 of the coaxial RF transmission line, forward biases one diode and, simultaneously, reverse biases the other diode. In particular, a d.c. bias signal is applied to the phase shifter simultaneously with the input signal whose phase is to be shifted. Since the bias signal is d.c., it will not be radiated. However, given that the diodes 50 and 52 are of opposite conductivity types, this signal produces the single pole, double-throw switch action discussed above with respect to FIG. 1*c*. In accordance with the invention, the dipole element itself serves as a d.c. return to the outer conductor 34 of the coaxial RF transmission line. Specifically, the first dipole arm 12 serves as a groundplane for the quarter-wave transformer 54. Likewise, the second dipole arm 14 serves as a groundplane for the quarter-wave transformer 56. Therefore, it can be seen that in accordance with the phase shifter of the present invention, the use of the diodes of opposite conductivity type allows the center conductor 22 to function as a common bias line for simultaneously forward biasing one diode and reverse biasing the other. The phase shifter of FIG. 2 is the 180 degree dipole phase shifter shown conceptually in FIG. 1*d*. In operation, the diodes 50 and 52 are selectively biased to produce the 180 degree change of phase in the signal radiated. Specifically, when PIN diode 50 is forward biased and NIP diode 52 is reverse biased, a 0 degree phase shift is produced. Likewise, when the PIN diode is reverse biased and the NIP diode is forward biased, a 180 degree phase shift is produced.

Referring now to FIG. 3, a partial side view of the dipole phase shifter of the present invention is shown located approximately one quarter-wavelength above a groundplane 66 mounted on the coaxial RF transmission line. The structure shown in FIG. 3 is the preferred embodiment of the invention since this configuration is more likely to be used in phased array antenna systems. The groundplane 66 includes an adjusting block 68 having an adjusting set screw 70 which may be loosened so as to allow the groundplane 66 to be selectively located on the coaxial RF transmission line with respect to the insulating substrate 28.

FIG. 3 also shows the dipole phase shifter of FIG. 2 in completed form. Specifically, the diodes 50 and 52 are secured to the mounting pedestals 46 and 48 which, as discussed above, serve to electrically connect the diodes to the first and second dipole arms 12 and 14, respectively. As best seen in FIG. 3, the first and second dipole arms 12 and 14 are attached to the first and second sections 36 and 38 of the balun 35. Preferably, the dipole arms are soldered as designated at 72, however, any other suitable form of electrical connection may be utilized.

Therefore, in accordance with the present invention, a dipole phase shifter for use in a phased array antenna is provided comprising an insulating substrate having first and second sides. A dipole formed on the first side of the insulating substrate includes first and second conductive dipole arms. A PIN diode is mounted on the second side of the insulating substrate and electrically connected to the first dipole arm. Similarly, a NIP diode is mounted on the second side of the insulating substrate and electrically connected to the second dipole arm. Quarter-wave transformers are mounted on the second side of the insulating substrate between the diodes and the center conductor of a coaxial RF transmission line for transforming the forward and reverse bias reactances of the diodes to open and short circuits, respectively. The dipole arms serve as groundplanes for the respective quarter-wave transformers. In operation, the 180 degree phase shift of the input signal is provided by forward biasing one diode and, simultaneously, reverse biasing the other. The dipole element itself serves as a d.c. return to the outer conductor of the coaxial RF/bias line.

In a prior art phased array antenna structure having a phase shifter-per-element configuration, the phase shifter was usually the major contributor to both the cost and weight budgets, and contributed significantly to the RF loss budget. A 180 degree dipole phase shifter constructed according to the present invention requires no increase in frontal area of the printed circuit dipole and adds only extremely minimal weight to the already existing printed circuit dipole. In effect, the 180 degree dipole eliminates the volume and weight required by the printed circuit prior art 180 degree phase shifter, and exhibits lower measured insertion loss. For X-band operation, typical dipole length is 0.6 inches, and the distance between the insulating substrate and the groundplane is on the order of 0.3 inches. These dimensions produce reasonable dipole input impedance.

Although the invention has been described and illustrated in detail, it is to be clearly understood that the same is by way of illustration and example only and is not to be taken by way of limitation. The spirit and scope of this invention are to be limited only by the terms of the appended claims.

We claim:

1. A dipole phase shifter for use in a phased array antenna, comprising:

an insulating substrate having first and second sides;

a dipole formed on said first side of said insulating substrate, said dipole having first and second conductive dipole arms;

a first diode of a predetermined conductivity type mounted on said second side of said insulating substrate and electrically-connected to said first dipole arm;

a second diode of an opposite conductivity type with respect to said first diode, said second diode mounted on said second side of said insulating substrate and electrically-connected to said second dipole arm;

input/bias means attached to said substrate for connecting both an input signal to said phase shifter and a bias signal to said first and second diodes, said bias signal alternatively biasing said diodes into a conductive state to produce a phase shift to said input signal;

said input/bias means including an RF coaxial transmission line having a center conductor which extends through said insulating substrate to the second side thereof, and an outer conductor connected to said and first second dipole arms, said input/bias means further including transformation means mounted on said second side of said insulating substrate between said first and second diodes and said center conductor to compensate for the forward and reverse bias reactances of said first and second diodes.

2. The dipole phase shifter as described in claim 1 wherein said transformation means includes a first portion mounted on said second side of said insulating substrate between said first diode and said center conductor to compensate for the forward and reverse bias reactances of said first diode, said first dipole arm serving as a groundplane for said first portion.

3. The dipole phase shifter as described in claim 1 wherein said transformation means further includes a second portion mounted on said second side of said insulating substrate between said second diode and said center conductor to compensate for the forward and reverse bias reactances of said second diode, said second dipole arm serving as a groundplane for said second portion.

4. The dipole phase shifter as described in claim 2 wherein said outer conductor includes a balun having first and second sections, said first section connected to said first dipole arm and said second section connected to said second dipole arm.

5. The dipole phase shifter as described in claim 4 further including first conductive support means mounted in said insulating substrate for supporting said first diode and electrically-connecting said first diode to said first dipole arm and said first section of said balun.

6. The dipole phase shifter as described in claim 4 further including second conductive support means mounted in said insulating substrate for supporting said second diode and electrically-connecting said second diode to said second dipole arm and said second section of said balun.

7. The dipole phase shifter as described in claim 1 wherein said first diode is a microwave PIN diode.

8. The dipole phase shifter as described in claim 1 wherein said second diode is a microwave NIP diode.

9. The dipole phase shifter as described in claim 1 wherein said insulating substrate is formed from a teflon/glass fibre material.

10. A dipole phase shifter for use in a phased array antenna, comprising:

an insulating substrate having first and second sides;

a dipole formed on said first side of said insulating substrate, said dipole having first and second conductive dipole arms;

a PIN diode mounted on said second side of said insulating substrate and electrically-connected to said first dipole arm;

a NIP diode mounted on said second side of said insulating substrate and electrically-connected to said second dipole arm;

input/bias means including a coaxial RF transmission line having a center conductor which extends through said insulating substrate, said transmission line including an outer conductor connected to said first and second dipole arms; said input/bias means for connecting both an input signal to said phase shifter and a bias signal to said diodes, wherein said diodes form a single pole, double throw switch to effect a phase shift in said input signal;

said input/bias means including a first quarter-wave transformer mounted on said second side of said insulating substrate between said PIN diode and said center conductor to compensate for the forward and reverse bias reactances of said PIN diode, said first dipole arm serving as a groundplane for said first quarter-wave transformer; and said input/bias means further including a second quarter-wave transformer mounted on said second side of said insulating substrate between said NIP diode and said center conductor to compensate for the forward and reverse bias reactances of said NIP diode, said second dipole arm serving as a groundplane for said second quarter-wave transformer.

11. The dipole phase shifter as described in claim 10 wherein said outer conductor includes a balun having first and second sections, said first section connected to said first dipole arm and said second section connected to said second dipole arm.

12. The dipole phase shifter as described in claim 11 further including a conductive pedestal mounted in said insulating substrate for supporting said PIN diode and electrically-connecting said PIN diode to said first dipole arm and said first section of said balun.

13. The dipole phase shifter as described in claim 11 further including a conductive pedestal mounted in said insulating substrate for supporting said NIP diode and electrically-connecting said NIP diode to said second dipole arm and said second section of said balun.

14. A dipole phase shifter for use in a phased array antenna, comprising:

an insulating substrate having first and second sides;

a dipole formed on said first side of said insulating substrate, said dipole having first and second conductive dipole arms;

a PIN diode mounted on said second side of said insulating substrate;

a conductive pedestal mounted in said substrate for supporting said PIN diode and electrically-connecting said PIN diode to said first dipole arm;

a NIP diode mounted on said second side of said insulating substrate;

a conductive pedestal mounted in said substrate for supporting said second diode and electrically-connecting said NIP diode to said second dipole arm;

a coaxial RF transmission line having a center conductor which extends through said insulating substrate, and an outer conductor connected to said first and second dipole arms;

a first quarter-wave transformer mounted on said second side of said insulating substrate between said PIN diode and said center conductor to compensate for the forward and reverse bias reactances of said PIN diode; and a second quarter-wave transformer mounted on said second side of said insulating substrate between said NIP diode and said center conductor to compensate for the forward and reverse bias reactances of said NIP diode, wherein said center conductor is utilized as a common bias line for said PIN and NIP diodes such that said diodes may be alternatively biased into a conductive state, said biasing producing a phase shift of an input signal applied to said phase shifter.

15. The dipole phase shifter as described in claim 14 wherein said first dipole arm serves as a groundplane for said first quarter-wave transformer.

16. The dipole phase shifter as described in claim 14 wherein said second dipole arm serves as a groundplane for said second quarter-wave transformer.

* * * * *